US008206512B2

(12) United States Patent
Gnadinger et al.

(10) Patent No.: US 8,206,512 B2
(45) Date of Patent: Jun. 26, 2012

(54) AUTOMATIC AND MANUAL DETERGENT TYPE IDENTIFICATION TO SELECT A WASH ALGORITHM BASED ON DETERGENT TYPE

(75) Inventors: Errin Whitney Gnadinger, Louisville, KY (US); Mark Douglas Wattley, Louisville, KY (US); Mark A. Banta, Crestwood, KY (US); James Christopher Roberts, Louisville, KY (US)

(73) Assignee: General Electric Company, Schenectady, NY (US)

( * ) Notice: Subject to any disclaimer, the term of this patent is extended or adjusted under 35 U.S.C. 154(b) by 346 days.

(21) Appl. No.: 12/538,462

(22) Filed: Aug. 10, 2009

(65) Prior Publication Data

US 2011/0030729 A1 Feb. 10, 2011

(51) Int. Cl.

| | |
|---|---|
| ***B08B 7/00*** | (2006.01) |
| ***B08B 7/04*** | (2006.01) |
| ***D06F 3/00*** | (2006.01) |
| ***D06F 33/00*** | (2006.01) |

(52) U.S. Cl. ..... 134/18; 134/25.2; 134/56 D; 134/57 D; 134/58 D; 68/12.02; 68/12.05; 68/12.27; 68/13 R; 8/158

(58) Field of Classification Search ..... 134/18, 134/25.2, 56 R, 57 R, 57 D, 56 D, 58 R, 58 D; 68/12.02, 12.05, 13 R, 12.27; 8/158
See application file for complete search history.

(56) References Cited

U.S. PATENT DOCUMENTS

| | | | | |
|---|---|---|---|---|
| 1,508,469 | A | 11/1975 | Osgood | |
| 4,756,321 | A | 7/1988 | Livingston et al. | |
| 5,083,447 | A * | 1/1992 | Kiuchi et al. | 68/12.05 |
| 5,438,507 | A * | 8/1995 | Kim et al. | 700/1 |
| 6,691,536 | B2 * | 2/2004 | Severns et al. | 68/12.27 |
| 6,990,411 | B2 | 1/2006 | Peterson et al. | |
| 7,444,842 | B2 * | 11/2008 | Kim et al. | 68/12.18 |
| 2004/0236522 | A1 | 11/2004 | Howes, Jr. et al. | |
| 2004/0245284 | A1 | 12/2004 | Mehus et al. | |
| 2004/0261434 | A1 | 12/2004 | Zentner et al. | |
| 2005/0028297 | A1 * | 2/2005 | Kim et al. | 8/159 |
| 2005/0149273 | A1 | 7/2005 | Peterson et al. | |
| 2006/0216217 | A1 | 9/2006 | Chan et al. | |
| 2007/0143933 | A1 * | 6/2007 | Potyrailo et al. | 8/158 |
| 2008/0060688 | A1 * | 3/2008 | Buser | 134/56 D |
| 2008/0264448 | A1 * | 10/2008 | Berends et al. | 134/18 |
| 2010/0212700 | A1 * | 8/2010 | Wattley et al. | 134/93 |

FOREIGN PATENT DOCUMENTS

EP 0 894 024 B1 8/1997

* cited by examiner

*Primary Examiner* — Alexander Markoff
(74) *Attorney, Agent, or Firm* — Fay Sharpe LLP

(57) ABSTRACT

A detergent module for dispensing detergent during a wash-cycle is presented in which a sensor senses and indicates or a user via control input indicates whether the detergent in the module is a solid-type detergent or a liquid-type detergent, and the detergent-type indication is used by a dishwashing machine or a laundry washing machine to select a washing algorithm tailored to exploit the cleaning efficiency of the detergent.

24 Claims, 3 Drawing Sheets

AUTOMATIC AND MANUAL DETERGENT TYPE IDENTIFICATION TO SELECT A WASH ALGORITHM BASED ON DETERGENT TYPE

BACKGROUND OF THE DISCLOSURE

Most machines for washing articles, such as dishes or laundry, require a detergent as the cleaning agent. This detergent is available in several forms including liquid, gel, powder, and tablet. Regardless of the form of the detergent, the active cleaning agent within the detergent may be chlorine-based or enzyme-based. The current approach washes the articles the same way, regardless of whether the detergent used is a solid-type or liquid-type, or whether it is chlorine-based or enzyme-based. This approach may not maximize the effectiveness of the detergent used, which may result in substandard washing. Thus, there is a continuing need for a machine that exploits the efficiency of the detergent used during the wash-cycle.

SUMMARY OF THE DISCLOSURE

The present disclosure provides a detergent module apparatus and control techniques that may be employed to determine if the detergent stored in the module is a solid-type or liquid-type detergent. This determination may then be used by a machine controller to select a wash algorithm based at least in part upon the type of detergent stored in the detergent module to facilitate effective utilization of the cleaning efficiency of the detergent.

A detergent module for dispensing detergent during a wash-cycle is disclosed, which includes a compartment with an opening to dispense the detergent and to allow the compartment to be thoroughly rinsed at some point during the wash-cycle. The detergent module also includes a sensor which provides a signal that indicates whether the detergent in the compartment is a solid-type or liquid-type detergent.

In some embodiments, the detergent module is situated in a dishwashing machine, and in other embodiments the detergent module is situated in a washing machine for laundry. Regardless of the type of machine, the detergent module may include a cover that opens at a point during the wash-cycle to dispense the detergent and allows the compartment to be rinsed. In other embodiments, water may be mixed with the detergent to create a washing solution while it is in the compartment and the pressure from the water source forces the washing solution from the detergent module. In some embodiments, the module includes multiple compartments which can individually store and dispense detergent during the wash-cycle.

A dishwasher is provided, which includes a housing, connections for water supply and removal, a heating element, a detergent module to store and dispense detergent during a wash-cycle, and a machine controller which selects a wash algorithm based at least in part upon the type of detergent stored in the detergent module. In some embodiments, the type of detergent is received from a user-input, where the user manually enters the type and subtype of detergent in the detergent module. In other embodiments, the dishwasher includes a sensor which determines whether the detergent is a solid-type or liquid-type detergent and provides that signal to the machine controller.

A clothes washer is provided, which includes a housing, connections for water supply and removal, a detergent module to store and dispense detergent during a wash-cycle, and a machine controller which selects a wash algorithm based at least in part upon the type of detergent stored in the detergent module. In some embodiments, the type of detergent is received from a user-input, where the user manually enters the type and subtype of detergent in the detergent module. In other embodiments, the dishwasher includes a sensor which determines whether the detergent is a solid-type or liquid-type detergent and provides that signal to the machine controller.

A method for washing articles is provided, which includes providing detergent to a detergent module in a machine, receiving a detergent-type signal which indicates whether the detergent in the detergent module is a solid-type detergent or a liquid-type detergent, selecting one of a plurality of different wash algorithms based at least in part on the detergent-type signal or value, and controlling the machine to perform a wash-cycle based on the selected wash algorithm. In some embodiments, the type of detergent is received from a user-input, where the user manually enters the type and subtype of detergent in the detergent module. In other embodiments, the dishwasher includes a sensor which determines whether the detergent is a solid-type or liquid-type detergent and provides that signal to the machine controller.

BRIEF DESCRIPTION OF THE DRAWINGS

One or more exemplary embodiments are set forth in the following detailed description and the drawings, in which.

DETAILED DESCRIPTION OF THE PREFERRED EMBODIMENTS

Figure 1:
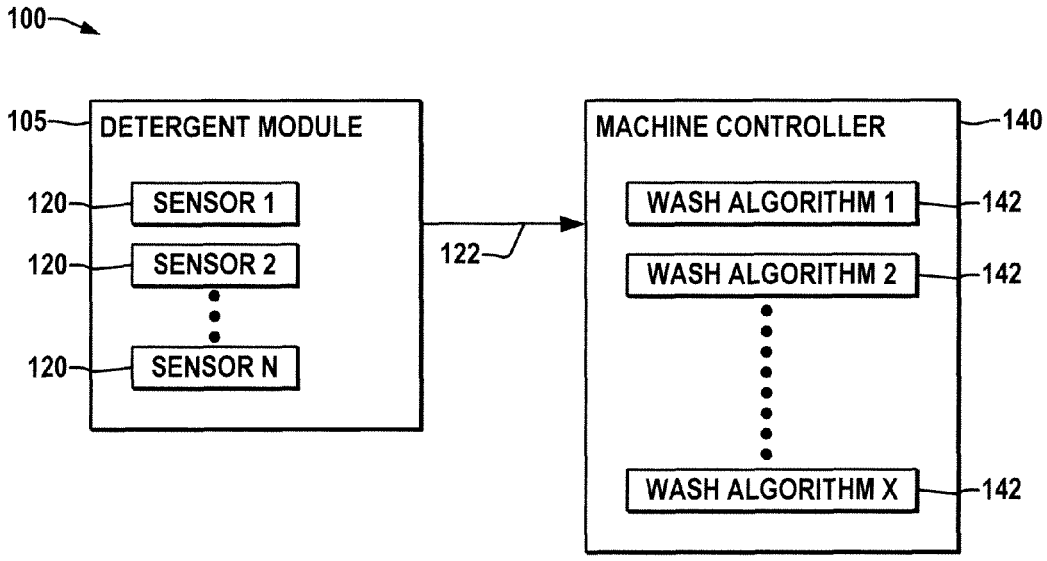
FIG. 1 is a schematic diagram illustrating an exemplary machine for washing articles including a detergent module for storing and dispensing detergent and a machine controller having multiple algorithms selected at least partially based upon the type of detergent stored in each of the one or more compartments of the detergent module.

For purposes of this disclosure, a "solid-type" detergent is a detergent in a dry, solid form such as, but not limited to, powder or tablet. A "liquid-type" detergent is a detergent in viscous form such as, but not limited to, liquid or gel. A "detergent-type" denotes whether the detergent is a solid-type or liquid-type detergent and may also include the "detergent-subtype" information. A "detergent-subtype" denotes whether the detergent is chlorine-based or enzyme-based. Finally, the term "wash-cycle" includes every stage of operation of a machine used for washing articles, including but not limited to, a pre-cleaning stage, a cleaning stage, a pre-rinse stage, a rinse stage, and a post-rinse stage.

Referring now to the drawings, where like reference numerals are used to refer to like elements throughout, and wherein the various features are not necessarily drawn to scale, the present disclosure relates to machines for washing articles and more particularly to those machines with multiple wash algorithms based at least in part upon the type of detergent used for the wash and will be described with particular reference thereto, although the exemplary apparatus and methods described herein can also be used in other dispensing algorithms based on other types of contents of a module, such as but not limited to bleach, rinse agent (e.g. Cascade Crystal Clear®, Jet-Dry®, white vinegar, etc.), and fabric softener and are not limited to the aforementioned application.

FIG. 1 illustrates an exemplary machine 100 for washing articles including a detergent module 105 and a machine controller 140. The exemplary detergent module 105 includes multiple compartments 114 (FIG. 2) wherein the compartments 114 individually include sensors 120 operative to determine whether the type of detergent stored within the associated compartment 114 is a solid-type or liquid-type detergent. The sensors 120 provide N detergent-type signals 122 to the machine controller 140, where N is a positive integer. The machine controller 140 will select from X wash algorithms 142 based, at least in part on the values of the detergent-type signals 122. The selected algorithm 142 will determine, inter alia, the timing and various temperatures of the wash-cycle. In some embodiments, the machine controller 140 is a microprocessor, while in other embodiments, the machine controller 140 is comprised of discrete circuitry. The controller 140 may be implemented as any suitable form of hardware, software, firmware, programmable logic, or combinations thereof, and may be a unitary control component or may be implemented in distributed fashion.

Figure 2:
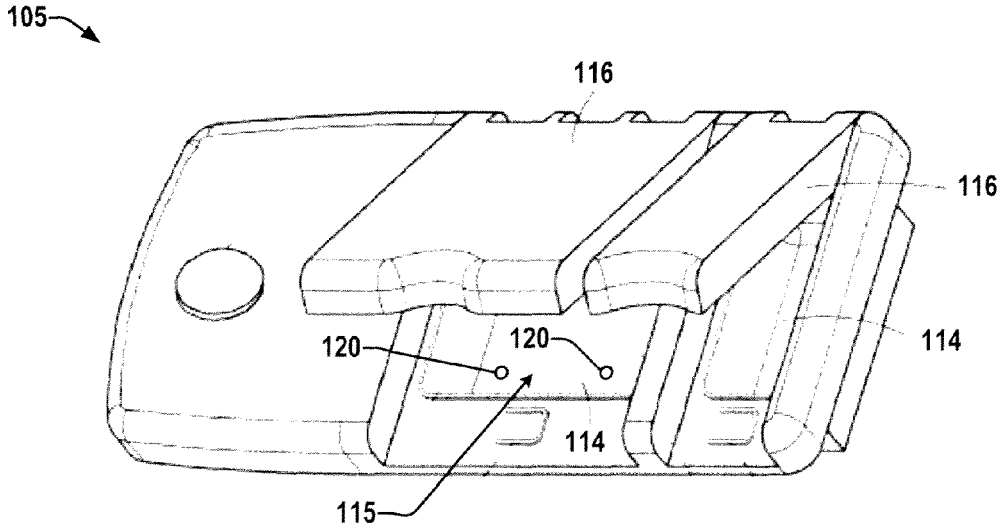
FIG. 2 is a perspective view of an exemplary detergent module with multiple compartments wherein individual covers close over corresponding individual compartments in the machine of FIG. 1.

FIG. 2 illustrates one suitable embodiment of a detergent module 105 including two compartments 114 with corresponding covers 116 and at least one sensor 120 to be used in a machine 100 for washing articles. The detergent is provided to the compartment 114 by a user or a bulk dispenser (not shown), and the cover 116 seals the compartment 114 to protect the detergent until the desired time in the wash-cycle determined by the selected wash algorithm 142. At the desired time, the cover 116 is opened by the machine controller 140, and the detergent stored in the compartment 114 is dispensed to the wash. The covers 116 shown in the example of FIG. 2 are opened along a horizontal hinge to allow detergent to be dispensed downward via gravity, but other embodiments allow the cover 116 to be, inter alia, opened along a vertical hinge, slid open via a sliding mechanism, or rotated open on an offset pivot hinge. In certain embodiments, water or the washing solution (water-detergent mixture) enters the compartment where it mixes with the detergent, and is dispensed to the wash tub of the machine through an opening. Other non-gravitational means can be provided to dispense the detergent.

FIG. 2 further illustrates a sensor 120 located in one of the compartments 114 of the detergent module 105. In the embodiment of FIG. 2, the sensor 120 is located at or near the bottom portion 115 of the compartment 114 such that as the module 105 is mounted upright (e.g., when the washer door is closed in a dishwasher implementation), gravity forces detergent toward the sensor 120. Two points of a conductivity sensor 120 are placed horizontally in spaced relationship to one another at the back of the compartment 114 in the example of FIG. 3. When a liquid-type detergent is added to the compartment 114 and the detergent module 105 is in position for a wash-cycle (e.g., upright in this embodiment), the conductivity of the detergent, due to the electrolytes in the detergent provides a relatively low resistance electrical connection between the two conductivity points of the sensor 120, which produces a signal 122 indicating the presence of a liquid-type detergent. A solid-type detergent presents a relatively high resistance electrical connection between the two conductivity points of the sensor 120, which produces a signal 122 indicating the absence of a liquid-type detergent. Other embodiments use other types of sensors such as, but not limited to, capacitive sensors or strips, ultrasonic sensors, and microwave sensors, or combinations thereof. The number of sensors 120 in the detergent module 105 may range from zero to the number of compartments 114 or more. In certain embodiments, a detergent-type signal 122 can be provided to the machine controller 140 by the user through a user-input. In such an embodiment, no sensor 120 is needed to determine the detergent-type. Other embodiments may provide for user-generated detergent-type signal(s) 122 in combination with sensor-generated detergent-type signal(s) 122. In certain embodiments, the user may also specify the detergent-subtype to the machine controller 120 through a user-input, and the machine controller selects a washing algorithm 142 based at least in part on the detergent-subtype.

A film of residual detergent left in the compartment 114 after a wash-cycle may produce a false presence of liquid-type detergent, so the compartments 114 of the exemplary module 105 include openings (via covers 116) to allow the compartment to be rinsed so there is limited or no residual detergent in the compartment 114. The sensor points 120 are placed in such a way that any leftover washing solution or water will not register a false positive on back-to-back washes. In one embodiment, the conductivity points are positioned sufficiently near the bottom of the compartment 114 when the detergent module 105 is in position for the wash-cycle to allow for sensing the typical minimum amount of detergent, but spaced sufficiently from the lowest point of the compartment in the wash cycle position to not respond to leftover washing solution or water in the compartment.

Figure 3:
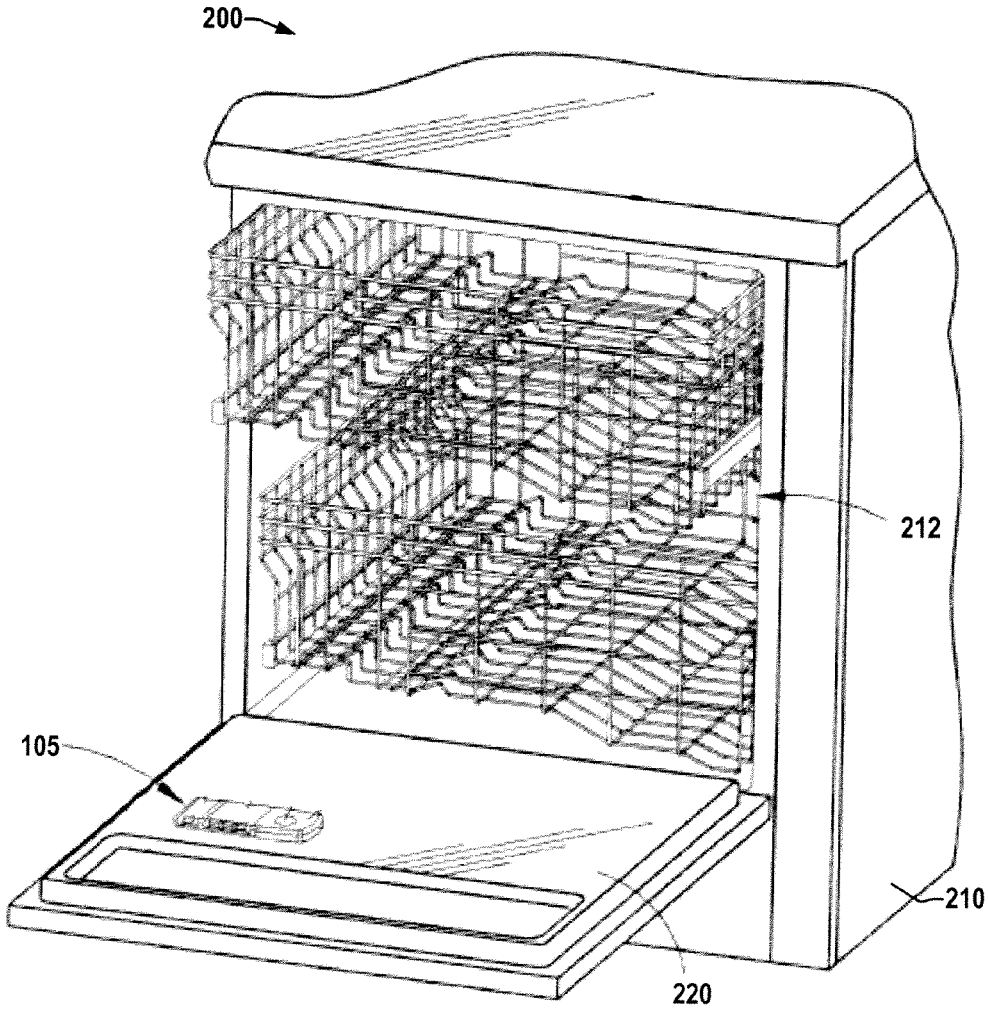
FIG. 3 is a front-elevational view of an exemplary dishwasher machine embodiment including the exemplary detergent module of FIG. 1.

FIG. 3 illustrates an exemplary dishwasher 200 including the exemplary multi-compartment detergent module 105 of FIG. 2 mounted on the door 220. The dishwasher 200 further includes a housing 210 and a wash tub 212. In one embodiment, the machine controller 140 is located in the detergent module 105, or the controller 140 may be separately located with suitable interconnections to provide the detergent-type signal 122 and other appropriate signaling between the controller 140 and the module 105. The dishwasher 200 functions as the machine 100 described above.

Figure 4:
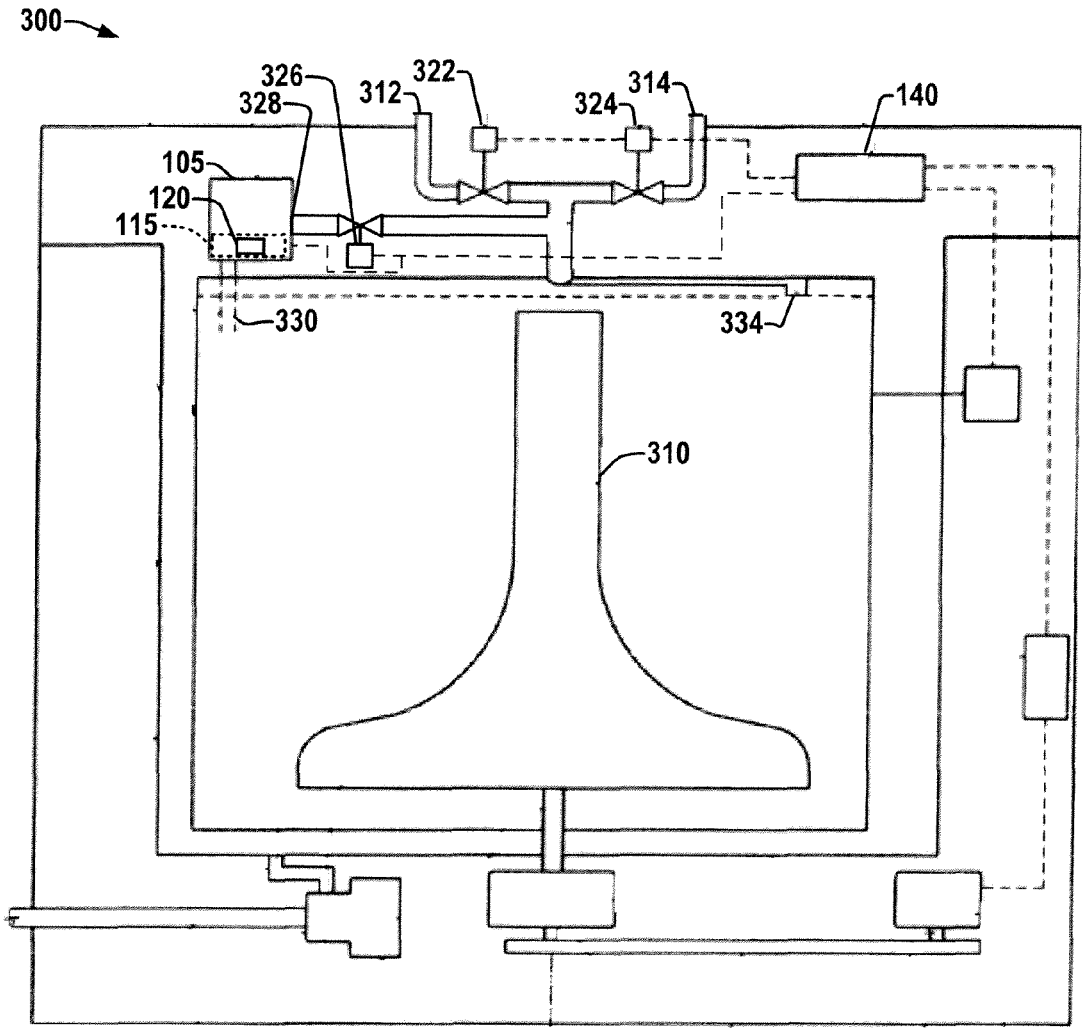
FIG. 4 is a schematic drawing of an exemplary laundry washing machine embodiment.

FIG. 4 illustrates an exemplary laundry washing machine 300 including a detergent module 105, machine controller 140, an agitator 310, and hot and cold water supplies 312, 314. Other washing machine embodiments are possible that do not include an agitator. Either user-input or the sensor 120 (FIG. 1) provides a detergent-type signal to the machine controller 140, which will select a wash algorithm 142 (FIG. 1) based at least in part on the detergent-type. The machine controller 140 will then control the valves 322, 324, 326 and agitator 310 during the wash-cycle according to the selected wash algorithm 142. When the machine controller 140 determines that detergent should be added to the tub, it activates valve 326 to cause water to flow through an opening 328 of the module 105 so as to mix the water with the detergent and dispense the solution to the tub through tube 330. During this process, at least the region of the compartment 114 (FIG. 2) proximate sensor 120 is sufficiently rinsed of any residual washing solution to avoid a false sensor response.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. Obviously, modifications and alterations will occur to others upon reading and understanding the preceding detailed description. It is intended that the invention be construed as including all such modifications and alterations.

The following is claimed:

1. A detergent module or dispensing detergent during a wash-cycle, comprising:

at least one compartment operative to store and dispense detergent, a sensor mounted in a sensor portion located at or near a bottom of the at least one compartment and proximate to a detergent stored in the at least one compartment, the sensor is operative to produce a detergent-type signal indicating whether the detergent stored in the at least one compartment is a solid-type detergent or a liquid-type detergent;

the at least one compartment including an opening allowing fluid to enter the at least one compartment to rinse at least a portion of the at least one compartment proximate to the sensor during the wash cycle.

2. The detergent module of claim 1, wherein the module is operative to dispense at least a portion of the detergent stored in the at least one compartment during a wash or pre-rinse cycle of a dishwasher.

3. The detergent module of claim 2, wherein the sensor is a conductivity sensor.

4. The detergent module of claim 2, wherein the sensor is a capacitive sensor.

5. The detergent module of claim 2, further comprising one of: a cover with a vertical hinge such that the cover is operative to flip open to dispense at least a portion of the detergent stored in the at least one compartment at a desired time within the wash or pre-rinse cycle, a cover with a horizontal hinge such that the cover is operative to flip open to dispense at least a portion of the detergent stored in the at least one compartment at a desired time within the wash or pre-rinse cycle, a cover with a sliding mechanism such that the cover is operative to slide open to dispense at least a portion of the detergent stored in the at least one compartment at a desired time within the wash or pre-rinse cycle, or a cover with a pivot hinge such that the cover is operative to rotate open to dispense at least a portion of the detergent stored in the at least one compartment at a desired time within the wash or pre-rinse cycle.

6. The detergent module of claim 2 further comprising:

a plurality of compartments individually operative to store and to isolate a detergent from at least one other detergent stored in the other compartments, wherein the sensor senses the detergent-type in at least one of the compartments and produces at least one detergent-type signal; and a plurality of covers individually operative to seal a corresponding one of the compartments until the detergent is released.

7. The detergent module of claim 1, wherein the module is operative to dispense at least a portion of the stored detergent during a laundry wash or pre-rinse cycle of a washing machine.

8. The detergent module of claim 7, wherein the sensor is a conductivity sensor.

9. The detergent module of claim 7, wherein the sensor is a capacitive sensor.

10. A dishwasher, comprising:

a housing having a wash chamber, a connection to a water supply, a connection for water removal, and a heating element;

a door;

a detergent module operative to store and dispense detergent during a wash-cycle having a sensor located in a sensor portion of the detergent module, the sensor portion located at or near a bottom of a compartment of the detergent module, the sensor is operative to produce a detergent-type signal indicating whether the detergent stored in the compartment is a solid-type detergent or a liquid-type detergent; and a machine controller configured to implement different first and second detergent-type wash algorithms which determine an operation of the connection to the water supply, the connection for water removal, the heating element, and the detergent module during the wash-cycle, the machine controller operative to selectively employ a selected one of the first and second algorithms based at least in part on whether the detergent contained in the detergent module is a solid-type detergent or a liquid-type detergent.

11. The dishwasher of claim 10, wherein the detergent module includes:

a module with at least one compartment operative to store and dispense detergent, and a sensor mounted proximate detergent stored in the compartment and operative to produce a detergent-type signal indicating whether the detergent stored in the compartment is a solid-type detergent or a liquid-type detergent;

the compartment including at least one opening allowing fluid to enter the compartment to rinse at least a portion of the compartment proximate the sensor.

12. The dishwasher of claim 11, wherein the sensor is a conductivity sensor.

13. The dishwasher of claim 11, wherein the sensor is a capacitive sensor.

14. The dishwasher of claim 10, further comprising a user interface operative to receive a manual input from a user and to provide a detergent-type signal to the machine controller indicating whether the detergent contained in the detergent module is a solid-type detergent or a liquid-type detergent.

15. The dishwasher of claim 10, wherein the machine controller includes different first and second detergent-sub-type wash algorithms which determine the operation of at least one of the connection to the water supply, the connection for water removal, the heating element, and the detergent module during the wash-cycle, and wherein the machine controller is operative to selectively employ a selected one of the first and second algorithms based at least in part on whether the detergent contained in the detergent module is an enzyme-based detergent or a chlorine-based detergent.

16. A clothes washer, comprising:

a housing having a wash chamber, a connection to a water supply, and a connection for water removal;

a door;

a detergent module operative to store and dispense detergent during a wash-cycle having a sensor operative to produce a detergent-type signal indicating whether the detergent stored in the detergent module is a solid-type detergent or a liquid-type detergent, the sensor located in a sensor portion of the detergent module, the sensor portion located at or near a bottom of the detergent module; and a machine controller configured to implement different first and second detergent-type wash algorithms which determine the operation of at least one of the connection to the water supply, the connection for water removal, and the detergent module during the wash-cycle, the machine controller being operative to selectively employ a selected one of the first and second algorithms based at least in part on whether the detergent contained in the detergent module is a solid-type detergent or a liquid-type detergent.

17. The clothes washer of claim 6, wherein the detergent module includes:

a module with at least one compartment operative to store and dispense detergent; and a sensor mounted at least partially proximate detergent stored in the module and operative to produce a detergent-type signal indicating whether the detergent stored in the compartment is a solid-type detergent or a liquid-type detergent;

the module including at least one opening allowing fluid to enter the compartment to thoroughly rinse at least that portion of the compartment proximate the sensor during a wash-cycle.

18. The clothes washer of claim 17, wherein the sensor is a conductivity sensor.

19. The clothes washer 17, wherein the sensor is a capacitive sensor.

20. The clothes washer of claim 16, further comprising a user interface operative to receive a manual input from a user and to provide a detergent-type signal to the machine controller indicating whether the detergent stored in the compartment is a solid-type detergent or a liquid-type detergent.

21. The clothes washer of claim 16, wherein the machine controller is configured to implement different first and second detergent-subtype wash algorithms which determine an operation of at least one of the connection to the water supply, the connection for water removal and the detergent module during the wash-cycle, and wherein the machine controller is operative to selectively employ a selected one of the first and second algorithms based at least in part on whether the detergent contained in the detergent module is an enzyme-based detergent or a chlorine-based detergent.

22. A method of washing items comprising:

providing detergent to at least one compartment of a detergent module in a machine;

receiving a detergent-type signal or value from a sensor located in a sensor portion of the at least one compartment, the sensor portion located at or near a bottom of the at least one compartment which indicates whether the detergent in the at least one compartment of the detergent module is a solid-type detergent or a liquid-type detergent;

selecting one of a plurality of different wash algorithms based at east in part on the detergent-type signal or value; and controlling the machine to perform a wash-cycle based on the selected wash algorithm.

23. The method of claim 22 further comprising receiving a detergent-subtype signal or value which indicates whether the detergent in the detergent module is an enzyme-based detergent or a chlorine-based detergent, wherein selecting one of the plurality of different wash algorithms is done at least partially based on the detergent-subtype signal or value.

24. The method of claim 23, wherein the detergent-subtype signal is manually received from a user.

* * * * *